US010674790B2

(12) United States Patent
Seng

(10) Patent No.: US 10,674,790 B2
(45) Date of Patent: Jun. 9, 2020

(54) SELF-CLEANING FOOTWEAR SYSTEM

(71) Applicant: Sean Seng, Rowland Heights, CA (US)

(72) Inventor: Sean Seng, Rowland Heights, CA (US)

( * ) Notice: Subject to any disclaimer, the term of this patent is extended or adjusted under 35 U.S.C. 154(b) by 0 days.

(21) Appl. No.: 15/164,579

(22) Filed: May 25, 2016

(65) Prior Publication Data

US 2017/0150781 A1 Jun. 1, 2017

Related U.S. Application Data

(60) Provisional application No. 62/188,313, filed on Jul. 2, 2015.

(51) Int. Cl.

| | |
|---|---|
| ***A43B 5/08*** | (2006.01) |
| ***A43B 7/08*** | (2006.01) |
| ***A43B 13/20*** | (2006.01) |
| ***A43B 3/12*** | (2006.01) |

(52) U.S. Cl.

CPC ..... *A43B 13/203* (2013.01); *A43B 3/128* (2013.01); *A43B 5/08* (2013.01); *A43B 7/082* (2013.01); *A43B 7/087* (2013.01)

(58) Field of Classification Search

CPC ..... A43B 5/08; A43B 7/082; A43B 7/087; A43B 7/105

USPC ..... 36/3 B, 8.1

See application file for complete search history.

(56) References Cited

U.S. PATENT DOCUMENTS 635,101 A * 10/1899 Kennedy ..... A43B 7/087 36/3 B
4,100,685 A * 7/1978 Dassler ..... A43B 5/10 36/3 B
4,525,940 A * 7/1985 Mochizuki ..... A43B 5/08 36/11.5
4,888,887 A * 12/1989 Solow ..... A43B 7/082 36/147
5,950,332 A * 9/1999 Lain ..... A43B 17/08 36/147
6,305,099 B1 * 10/2001 Chu ..... A43B 7/08 36/29
6,467,191 B2 * 10/2002 Hayashi ..... A43B 7/06 36/29
7,367,142 B2 * 5/2008 Ferniani ..... A43B 3/108 36/100
8,001,702 B1 * 8/2011 Wasserman ..... A43B 7/082 36/3 A
2007/0240333 A1 * 10/2007 Le ..... A43B 5/08 36/30 R
2007/0294923 A1 * 12/2007 Hayakawa ..... A43B 7/081 36/3 B
2016/0120260 A1 * 5/2016 Hansen ..... A43B 7/087 36/3 B
2016/0206037 A1 * 7/2016 McCormick ..... A43B 7/088

* cited by examiner

*Primary Examiner* — Sharon M Prange

(57) ABSTRACT

The invention described herein is a self-cleaning footwear system comprising a sole, where a plurality of check valves are located within said sole. The plurality of check valves are preferably configured between an upper sole and a lower sole to allow debris to flow downwards but not upwards. The plurality of check valves preferably further comprise flap assemblies, where a length of flexible material preferably further comprises a semi-circular flap on one end. The flexible material is preferably a rubber-type material. The sole could be attached to normal footwear, as shown in a sandal. Alternately, the sole could be attached to any type of footwear.

17 Claims, 3 Drawing Sheets

SELF-CLEANING FOOTWEAR SYSTEM

CROSS-REFERENCE TO RELATED APPLICATIONS

The present application is related to and claims priority from prior provisional application Ser. No. 62/188,313, filed Jul. 2, 2015, entitled "AQUA LAND SANDALS", the contents of all of which are incorporated herein by this reference and are not admitted to be prior art with respect to the present invention by the mention in this cross-reference section.

DETAILED DESCRIPTION OF THE INVENTION

The following description of the preferred embodiments of the invention is intended to enable someone skilled in the prior art to make and use this invention, but is not intended to limit the invention to these preferred embodiments.

Figure 1:
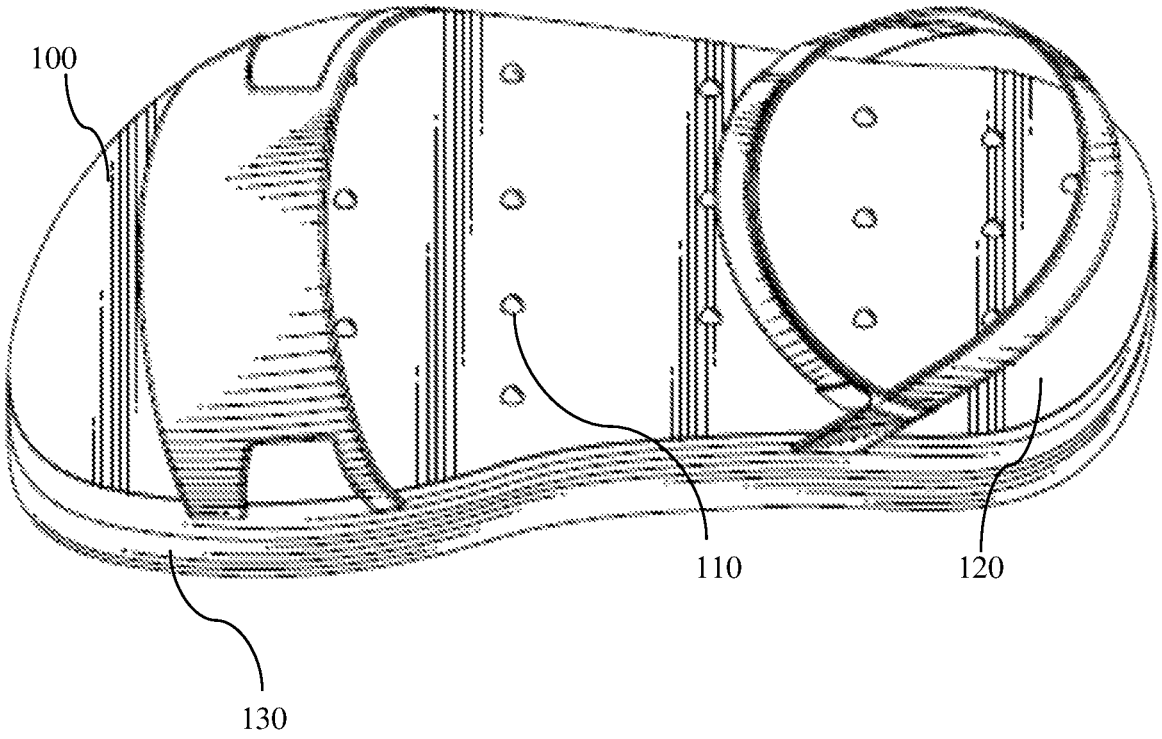
FIG. 1 is a perspective view for a SELF-CLEANING FOOTWEAR SYSTEM according to a preferred embodiment of the present invention.

Now referring to FIG. 1, the invention described herein is a self-cleaning footwear system comprising a sole 100, where a plurality of check valves are located within said sole 100. The plurality of check valves are preferably configured between an upper sole 120 and a lower sole 130 to allow debris to flow downwards but not upwards. The plurality of check valves preferably further comprise flap assemblies, where a length of flexible material preferably further comprises a semi-circular flap on one end. The flexible material is preferably a rubber-type material. The sole 100 could be attached to normal footwear, as shown in a sandal. Alternately, the sole could be attached to any type of footwear.

The sole 100 further comprises a plurality of holes 110 in an upper sole and a plurality of holes in a lower sole, where the plurality of holes 110 in the upper sole are preferably smaller in diameter than the plurality of holes in the lower sole, where the plurality of holes 110 in the upper sole are preferably in line with the plurality of holes in the lower sole; and where the plurality of check valves are preferably positioned in line with the plurality of holes 110 between said upper sole and said lower sole.

Figure 2:
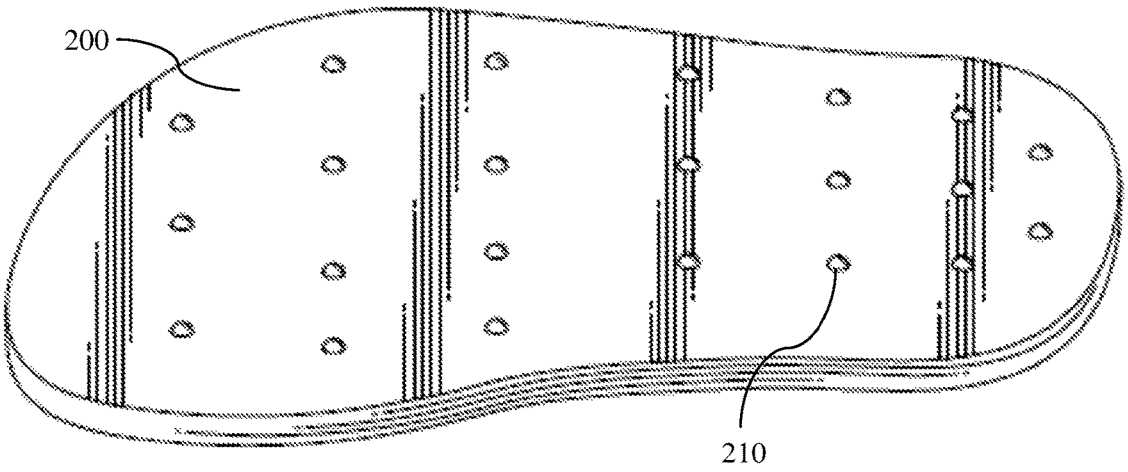
FIG. 2 is a perspective view of the upper sole for a SELF-CLEANING FOOTWEAR SYSTEM according to a preferred embodiment of the present invention.

As shown in FIG. 2, the upper sole 200 preferably comprises a plurality of perpendicular holes 210 preferably extending vertically through the thickness of the upper sole 200. The plurality of perpendicular holes 210 are preferably arranged through-out the surface of the upper sole 200. The plurality of perpendicular holes 210 are preferably smaller than the plurality of perpendicular holes in the lower sole. The plurality of perpendicular holes 210 in the upper sole 200 are preferably approximately in the range of 3 millimeters (mm) and 8 mm in diameter; however, the plurality of perpendicular holes 210 in the upper sole 200 may be any size that are preferably large enough to allow debris from inside the footwear to flow down through the plurality of perpendicular holes 210. Debris comprises various types of liquids, such as water, and solids, such as relatively small particles of sand.

Figure 3:
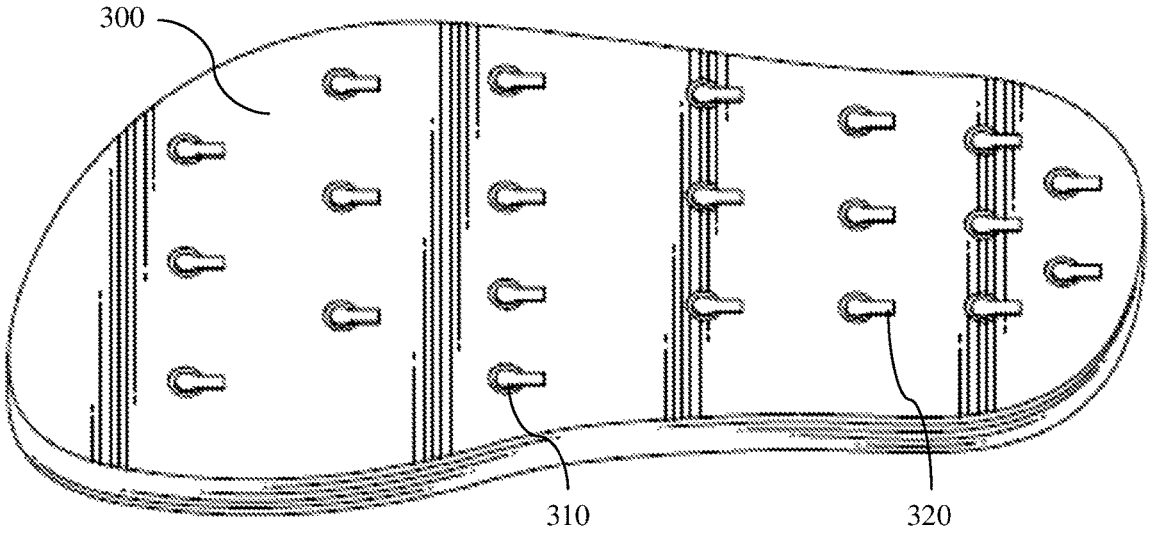
FIG. 3 is a perspective view of the lower sole for a SELF CLEANING FOOTWEAR SYSTEM according to a preferred embodiment of the present invention.

As shown in FIG. 3, the lower sole 300 preferably comprises a plurality of perpendicular holes 310 extending vertically through the thickness of the lower sole 300. The plurality of perpendicular holes 310 are preferably arranged through-out the surface of the lower sole 300. The plurality of perpendicular holes 310 in the lower sole 300 are preferably larger than the plurality of perpendicular holes in the upper sole 200. The plurality of perpendicular holes 310 in the lower sole 300 are preferably in the range of 7 millimeters (mm) to 15 mm in diameter; however, the plurality of perpendicular holes 310 in the lower sole 300 may be any size so long as they are larger than the plurality of perpendicular holes 210 in the upper sole 200. The plurality of holes in the upper sole 210 are preferably in line with the plurality of holes in the lower sole 300 when the upper sole 120 is placed onto the lower sole 130. The plurality of check valves are preferably further comprised of flap assemblies 320 arranged through-out the surface of the lower sole 300.

Figure 4A:
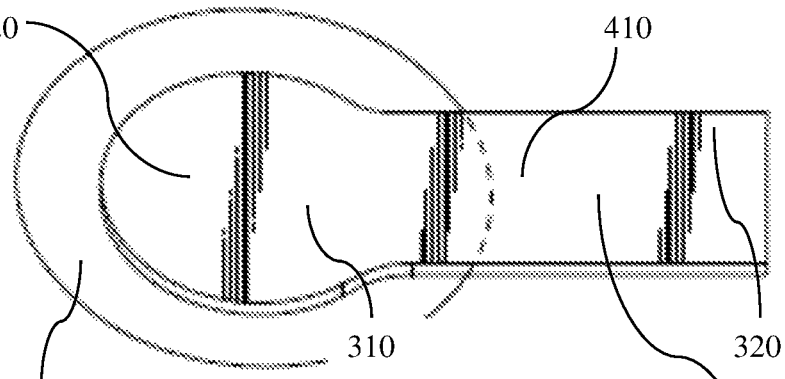
FIGS. 4A, 4B, and 4C are detailed views showing the check valve flap assembly for a SELF-CLEANING FOOTWEAR SYSTEM according to a preferred embodiment of the present invention.
Figure 4B:
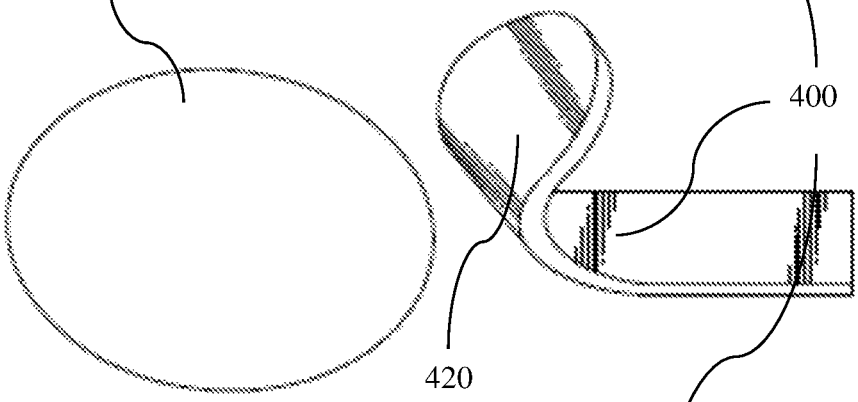
Figure 4C:
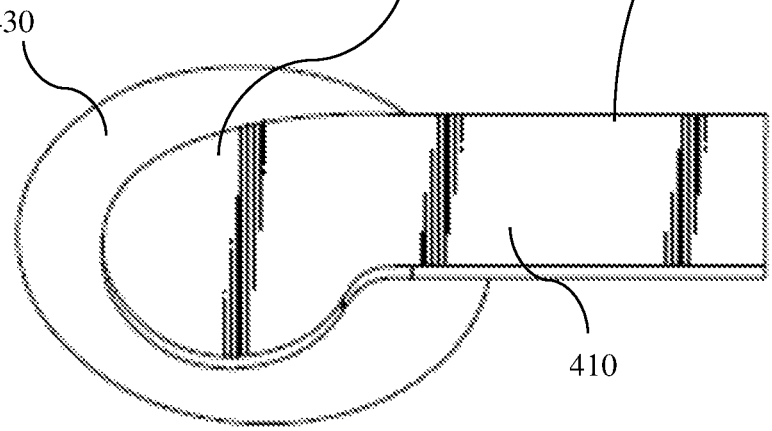

As shown in FIG. 4, the check valve flap assembly 400 is preferably one continuous piece of a flexible elastomer rubber-type material. The flap assembly 400 preferably comprises a length of flexible rubber-type material 410 and a semi-circular flap 420 preferably positioned at one end of the length of flexible rubber-type material 410. The flap 420 is preferably in the shape of a semi-circle. The flap 420 is preferably allowed to freely move and flex on the length of flexible rubber-type material 410. The diameter of the semi-circular flap 420 is preferably in the range of 5 millimeters (mm) to 12 mm; however, the diameter of the semi-circular flap 420 could be any size that is preferably larger than the plurality of holes in the upper sole and smaller than the plurality of holes in the lower sole.

The plurality of flap assemblies 320 are positioned such that the flap 420 covers each of the plurality of holes of the upper sole 210. Additionally, the plurality of flap assemblies 320 are positioned such that the flap 420 only partially covers, and is allowed to enter downwards, each of the plurality of perpendicular holes 430 of the lower sole 300. This configuration allows debris from inside the user's footwear to flow down through the plurality of holes in the upper sole 200 pushing the flap 420 of the flap assembly down and continuing through the plurality of holes in the lower sole 430 to the ground.

Preferably, the flap assembly is securely attached to said lower sole preferaby using glue or other securing means. The length of material connected to the flap is preferably secured to the lower sole such that when laid flat, the flap is centered over each of the plurality of holes in the upper and lower sole. Because the flap is smaller in diameter than the size of the holes in the lower sole, the flap will be allowed to extend into the holes of the lower sole. The flap will be held in place by being a part of the length of material securely attached to the lower sole. The flap assemblies will be securely attached to the lower sole using glues compatible to the material of the upper and lower soles. The upper sole will be located on the lower sole such that the plurality of holes in the upper sole will be lined up on center with the plurality of holes in the lower sole, and lined up on center with the flaps of the flap assemblies secured to the lower sole. Because the plurality of holes in the upper sole are smaller in diameter than the plurality of flaps, the flap will seal itself and completely cover each of the plurality of holes in the upper sole.

Alternatively, the length of material and the flap comprising the flap assembly may be comprised of different flexible materials and securely fastened to each other. Alternate materials may include, but is not limited to, flexible plastics, silicone rubber, flourosilicone rubber, polyurethane and natural rubber. This list of materials is not exclusive, and other materials may be used that are not enumerated herein. The flap 420 would be securely fastened to the length of material 410, which is further securely attached to the lower or upper sole. Means of attaching the flap to the length of material would include, but not be limited to, various bonding or fastening methods common with the types of materials. For example, various bonding or fastening means would include various types of rubber compatible glues and mechanical fasteners.

Preferably, the performance of the flap assembly is such that liquids and debris that enter into the user's footwear are allowed to drain from the top of the sole through the plurality of holes and check valves, but prevent liquids and debris from entering the user's footwear from the bottom of the sole. The size of the flap is preferably smaller than the holes in the lower sole to allow water and debris to flow down through the holes in the upper and lower soles and out of the self-cleaning footwear. The activation of the flap assembly occurs when the liquids and debris exert pressure downwards and the foot pushes air downwards through the plurality of holes when the user steps. This pressure pushes the flap down into the plurality of larger diameter holes in the lower sole along with the water and debris accumulated in the user's footwear on top of the upper sole under the user's foot.

Additionally, when the user steps down, the air pressure created under the bottom of the lower sole will push upwards through the plurality of holes in the lower sole and push the flap upwards to seal against the plurality of smaller holes in the upper sole. This prevents liquids and debris from entering the footwear, thus keeping the inside of the self-cleaning footwear free from collecting any liquids and debris being stepped upon.

I claim:

1. A self-cleaning footwear system comprising:

an upper sole comprising a plurality of first holes;

a lower sole comprising a plurality of second holes, wherein an each first hole of the plurality of first holes is centered above a respective second hole of the plurality of second holes, and the each first hole comprises a smaller diameter than the respective second hole; and a plurality of check valves configured to allow liquids and debris to flow downwards out of a bottom surface of the lower sole but not upwards from the lower sole to the upper sole, wherein an each of the plurality of check valves is located between the each first hole of the upper sole and the respective second hole of the lower sole, wherein the each of the plurality of check valves comprises a flap assembly strip including a semi-circular flap on a first end of a length of continuous material and a rectangular end opposite the first end, wherein the semi-circular flap comprises a larger diameter than that of a respective each first hole and a smaller diameter than that of each respective second hole, wherein the flat rectangular end is configured to attach to the lower sole at a position outside of the circumference of the each respective second hole, and wherein the semi-circular flap is configured to only partially cover the each respective second hole and allow the flap to extend into the respective second hole of the lower sole; and wherein the bottom surface of the lower sole is configured to directly contact a ground surface upon which the wearer is exerting pressure.

2. The self-cleaning footwear system of claim 1 wherein the diameter of the semi-circular flap is in a range of 5 mm to 12 mm.

3. The self-cleaning footwear system of claim 1 wherein the flap assembly strip is comprised of a flexible material.

4. The self-cleaning footwear system of claim 1 wherein a diameter of the each first hole of the plurality of first holes in the upper sole is in a range of 3 mm to 8 mm.

5. The self-cleaning footwear system of claim 1 wherein a diameter of the each respective second hole in the lower sole is in a range of 7 mm to 15 mm.

6. The self-cleaning footwear system of claim 1 wherein the upper sole and the lower sole comprise a part of a shoe.

7. The self-cleaning footwear system of claim 1 wherein the upper sole and the lower sole comprise a part of a sandal.

8. A self-cleaning footwear system comprising:

an upper sole comprising a plurality of first holes extending throughout the upper sole;

a lower sole comprising a plurality of second holes extending throughout the lower sole, wherein an each first hole of the plurality of first holes corresponds with a respective second hole of the plurality of second holes;

a plurality of flap assembly strips positioned between the upper sole and the lower sole, wherein each of the plurality of flap assembly strips comprises a length of continuous material including a semi-circular flap on a first end and a rectangular end opposite the first end, wherein the semi-circular flap comprises a larger diameter than that of a respective first hole, wherein the flat rectangular end is configured to attach to the lower sole at a position outside of the circumference of the respective second hole corresponding with the respective first hole, and wherein the semi-circular flap comprises a smaller diameter than that of the respective second hole and is configured to only partially cover the respective second hole and allow the semi-circular flap to extend into the respective second hole of the lower sole;

an upper portion configured to attach to the upper sole and at least partially encapsulate a foot of a wearer;

wherein the plurality of flap assembly strips is configured to allow liquids and debris to flow downwards from the upper sole through the lower sole and out a bottom surface of the lower sole; and wherein the bottom surface of the lower sole is configured to directly contact a ground surface upon which the wearer is exerting pressure.

9. The self-cleaning footwear system of claim 8 wherein a diameter of the semi-circular flap is in a range of 5 mm to 12 mm.

10. The self-cleaning footwear system of claim 8 wherein the each of the plurality of flap assembly strips is comprised of a flexible material.

11. The self-cleaning footwear system of claim 8 wherein the upper portion is a sandal.

12. A self-cleaning footwear system comprising:

an upper sole comprising a plurality of first holes;

a lower sole comprising a plurality of second holes, wherein an each first hole of the plurality of first holes is centered above a respective second hole of the plurality of second holes; and a plurality of check valves configured to allow liquids and debris to flow downwards out of a bottom surface of the lower sole but not upwards from the lower sole into the upper sole, wherein an each of the plurality of check valves is located between the each first hole of the upper sole and the respective second hole of the lower sole; and wherein the each of the plurality of check valves comprises a flap assembly having a semi-circular flap on a first end of a length of continuous material and a rectangular end opposite the first end, wherein the semi-circular flap comprises a smaller diameter than that of each respective second hole, wherein the flat rectangular end is configured to attach to the lower sole at a position outside of the circumference of the each respective second hole, and wherein the semi-circular flap is configured to only partially cover the each respective second hole and allow the semi-circular flap to extend into the each respective second hole of the lower sole; and wherein the bottom surface of the lower sole is configured to directly contact a ground surface upon which the wearer is exerting pressure.

13. The self-cleaning footwear system of claim 12 wherein the diameter of the semi-circular flap is larger than a diameter of each first hole of the upper sole.

14. The self-cleaning footwear system of claim 12 wherein a diameter of the semi-circular flap is in a range of 5 mm to 12 mm.

15. The self-cleaning footwear system of claim 12 wherein a diameter of the each first hole in the plurality of first holes is in a range of 3 mm to 8 mm.

16. The self-cleaning footwear system of claim 12 wherein a diameter of the each respective second hole in the lower sole is in a range of 7 mm to 15 mm.

17. The self-cleaning footwear system of claim 12 wherein the upper sole and the lower sole comprise a part of a shoe.

* * * * *